US005277842A

United States Patent [19]

Wittekind et al.

[11] Patent Number: 5,277,842

[45] Date of Patent: Jan. 11, 1994

[54] SOLVENTS FOR AGENTS TO MASS DEACIDIFY BOOKS AND OTHER PAPER PRODUCTS IN AN ENVIRONMENTALLY SAFE MANNER

[75] Inventors: Juergen Wittekind; Peter Schwerdt, both of Frankfurt am Main; Rolf Eggersdorfer, Bad Homburg, all of Fed. Rep. of Germany

[73] Assignee: Battelle-Institut e.V., Fed. Rep. of Germany

[21] Appl. No.: 35,556

[22] Filed: Mar. 22, 1993

Related U.S. Application Data

[63] Continuation of Ser. No. 832,206, Feb. 6, 1992, abandoned.

[30] Foreign Application Priority Data

Feb. 14, 1991 [DE] Fed. Rep. of Germany ..... 4104515

[51] Int. Cl.[5] ..... A61L 13/00

[52] U.S. Cl. ..... 252/400.31; 427/372.2; 427/387

[58] Field of Search ..... 556/451, 456; 427/372.2, 384, 387; 162/160; 252/8.6, 188.1, 193, 397, 399, 400.3, 400.31

[56] References Cited

U.S. PATENT DOCUMENTS

| | | | |
|---|---|---|---|
| Re. 23,502 | 5/1952 | Barry et al. | 556/456 X |
| 2,386,441 | 10/1945 | Daudt | 556/456 |
| 2,441,098 | 5/1948 | Hyde | 556/456 |
| 2,491,843 | 12/1949 | Wilcock | 556/451 |
| 2,519,881 | 8/1950 | Brewer | 556/451 |
| 3,771,958 | 11/1973 | Kusterer et al. | 427/395 |
| 3,837,804 | 9/1974 | Walker et al. | 427/248 X |
| 3,969,549 | 7/1976 | Williams et al. | 427/248 |

FOREIGN PATENT DOCUMENTS

3904111C2 8/1990 Fed. Rep. of Germany .

*Primary Examiner*—Arthur C. Prescott
*Attorney, Agent, or Firm*—Quarles & Brady

[57] ABSTRACT

Solvents for agents or neutralizing media known in and of themselves for efficient, environmentally safe mass deacidification of books and other paper products, in the form of methylsiloxanes having at least two and maximally four silicon atoms, are a replacement for the previously used, environmentally unfavorable solvents such as chlorofluorohydrocarbons, whereby these special organosiloxanes are suitable to the same degree for use as solvents as well as for application in the recommended, efficient process and cause as little damage as possible to the books.

13 Claims, No Drawings

SOLVENTS FOR AGENTS TO MASS DEACIDIFY BOOKS AND OTHER PAPER PRODUCTS IN AN ENVIRONMENTALLY SAFE MANNER

This application is a continuation of application Ser. No. 07/832,206, filed Feb. 6, 1992 now abandoned.

BACKGROUND OF THE INVENTION

The invention relates to solvents for agents in the form of neutralizing media that efficiently mass deacidify books, printed matter and other paper products, as well as archived materials of all sorts, such as newspapers, records and documents.

All printed matter and paper products, in particular books, are subject to aging of the paper during storage, during the course of which traces of acid are released, leading to progressive damage to the paper.

If countermeasures are not undertaken, after a number of decades this damage can lead to the complete disintegration of the paper.

In order to preserve archives and libraries holding several hundred million books worldwide it is therefore necessary that the acid in the paper be neutralized and to simultaneously incorporate a buffering substance in the paper in sufficient quantity to neutralize acids released in the paper in the future.

In view of the very large quantity of books, only those processes which permit the efficient mass treatment of a large quantity of books in their entirety can be considered for this purpose; that is, processes which do not require opening the binding of the book and treating individual pages.

According to a process which is already known, the books are treated with vapor of metal alkyls for the purpose of deacidification, e.g. with diethylzinc vapor (U.S. Pat. No. 3,969,549). Due to moisture in the paper, the metal alkyl is converted to the oxide of the metal, e.g. into zinc oxide, which remains in the paper, neutralizing the free acids.

This process can be viewed as a "dry" process; that is, the books only come in contact with the vapor of the metal alkyl and are not saturated with a liquid.

This process achieves good deacidification, while not damaging the books.

The metal alkyls that are suitable for this application are, however, substances that are self-igniting in air and pose an extreme danger of fire and explosion and require the greatest degree of care and expensive safety measures to avoid serious accidents.

According to another known process, the so-called Wei-T'o process, the books are treated with solutions of an organo-metallic compound such as, for example, methylmagnesium carbonate, in suitable solvents such as the solvents mentioned below.

Using the example of methylmagnesium carbonate, this in turn is converted into magnesium oxide and magnesium carbonate by moisture in the paper, and both of these are capable of neutralizing the acids in the paper.

In contrast to the initially mentioned "dry" process, in this process the books are saturated with a liquid.

In addition to the main objective already mentioned, that being the deacidification of books, this process furthermore rinses away dust and dirt particles, similar to chemically cleaning textiles. Herein, aside from this process being safe, a further significant advantage can be seen.

It is necessarily true that very high requirements are placed on the chemical-physical properties of the solvents that are used in order to treat the books without damage.

Various secondary materials in addition to paper were and will be used in the manufacture of books, such as, for example, glue, adhesives, inks, including printing inks, cardboard, cloth, leather, and synthetics.

The solvents employed in the deacidification must neither damage the paper nor the secondary materials used to manufacture the book in any manner whatsoever. Since the solvents used in a dry process are removed from the books following the deacidification, the solvents must vaporize at temperatures which cause no damage to the books.

Previously, such non-damaging substances as fluorohydrocarbons and chlorofluorohydrocarbons (CFHC) were used along with the addition of alcohols such as, e.g., methanol or ethanol.

The mentioned fluorohydrocarbons and chlorofluorohydrocarbons are sufficiently compatible with most book materials and vaporize at temperatures at which, on the one hand, no significant evaporative losses occur during handling while, on the other hand, the books are not damaged.

However, in particular for chlorofluorohydrocarbons, there are highly significant manufacturing and application limitations as a result of their high potential for causing environmental and ozone layer damage.

In consideration of these worldwide limitations and their intensification as already fixed into contracts, a worldwide ban on application is to be expected.

German patent application DE 39 04 111 Al however specifies a process for mass deacidification of books and paper products in an environmentally safe manner, whereby emissions can be avoided to a large extent by means of an enclosed procedure and by carefully purifying the exhaust air. But if the production of fluorohydrocarbons or chlorofluorohydrocarbons is no longer possible in the foreseeable future as a result of a ban and/or voluntary discontinuance, suitable solvents for this efficacious, operationally safe and efficient process will be lacking.

The invention is thus assigned the basic task providing new solvents which are suitable for mass deacidification of paper products and permit their deacidification with the least possible damage to the products, while avoiding substances that have environmental drawbacks.

SUMMARY OF THE INVENTION

This task is achieved by means of the object of patent claim 1. Accordingly, methylsiloxane with at least 2 and a maximum of 4 silicon atoms or siloxane units are provided as an alternative to environmentally damaging chlorofluorohydrocarbons. These can be straight chain or cyclical compounds as well as mixtures thereof.

Surprisingly, the inventors have determined that organosiloxanes have good solvent properties for book deacidification, similar to previously used chlorofluorohydrocarbons but without the environmental problems that these materials exhibit and, moreover, can be applied very well in the recommended, efficient process.

Organosiloxanes—known in a high molecular form by the name silicones—have found a number of applications in technology, cosmetics and pharmaceuticals as a result of their good chemical and physical properties.

In particular, the novelty consists of the knowledge according to the invention, that the specified siloxanes indicated in patent claim 1, with 2 to 4 units that respectively feature 1 silicon atom (also referred to as siloxane units), make siloxanes particularly well suited as solvents for book deacidification.

The general structure of, e.g., straight chain siloxanes can be specified by the following formula:

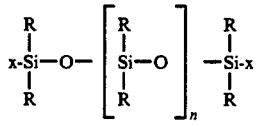

According to the invention, the organic groups hereby designated by R are occupied by CH− groups, since these siloxanes have a low boiling point and are thus particularly well suited for the application according to the invention. According to the invention, n=0 to 2, corresponding to the number of silicone atoms, from 2 to 4.

CH− groups can also replace x (the terminal silicon valences), whereby the compounds then feature particularly high chemical stability. Alternatively, instead of the x or R, hydrogen atoms or functional groups which can react with the paper fibers can be substituted.

With the use of these siloxanes, which can be applied in a mixture with siloxanes of the first mentioned group, the structure of the paper fibers can be positively influenced, and reinforcement of already damaged paper can thereby occur.

Consequently, mixtures of siloxanes with the above indicated n-values are also conceivable, as well as varying substitutions for, e.g., terminal and other silicone valences, leading to the optimization of solvents to the application in question.

Straight chain methylsiloxane, the R and x valences of which are saturated with CH− groups, featuring 5 silicon atoms or more, and with n>3, have an increasingly oily nature and an increasingly high boiling point which, e.g., is 120° C. for n=5 at 0.6 mbar. As a consequence of the high boiling points, these siloxanes are not suited for the intended application since, even in a vacuum, intolerably high temperatures would have to be employed to dry the books.

In contrast, methylsiloxanes with 2–4 silicon atoms or silicon atom units (n=0 to 2) have boiling points of 100°–150° C. at atmospheric pressure and viscosities of 0.65 mm2/s. Surprisingly, these siloxanes, as a result of their comparatively low boiling points, as a result of their low viscosities and their otherwise good chemical and physical properties, have proven themselves to be outstanding solvents for book deacidification. The mentioned substances are colorless, odorless liquids with low viscosities and very low surface tensions, vaporizing without residues at comparatively low temperatures.

In particular, low viscosity and surface tension also make these compounds particularly well suited for the mentioned purposes, since good and uniform saturation of the books is hereby possible.

Thus, e.g., hexamethyldisiloxane—a siloxane that features two silicon atoms (n=0)—has a viscosity of 0.65 mm2/s, a boiling point of 100° C. at atmospheric pressure and a surface tension of 15.9 mN/m; a siloxane consisting of four silicon atoms (n=2) has a boiling point of 150° C., a viscosity of 1.0 mm2/s and a surface tension of 16 mN/m.

The boiling point of the latter compound, which, at 150° C., is already too high for treating books without damage, can be decreased to ca. 70° C. at approximately 100 mbar through the use of a vacuum in the drying process of the books, as has found application in many areas of technology and is also indicated in DE 39 04 111 Al.

Siloxanes of the indicated type can be mixed with many other solvents, e.g. alcohols, which are used as dissolution mediums for methyl magnesium carbonate and contribute to its stability, and are good solvents for many organo-metallic compounds, while the materials and secondary materials which are used to manufacture books, such as, for example, printing inks, glue and adhesives, synthetics for book covers as well as inks including stamping inks are neither dissolved by siloxanes nor damaged in any way.

EXAMPLE

The following example is presented for illustrative purposes: rubber—insofar as it is not a special type of rubber—is destroyed or undergoes intense swelling by mineral oil and solvents such as aliphatic hydrocarbons, aromatics, esters and alcohols, whereas polysiloxanes of the indicated type are preferred lubricating and preserving agents for rubber.

The basis for this good compatibility is the chemical composition of siloxanes, which differs greatly from rubber elastomers in that its chemical configuration is more like that of the organo-metallic compounds used for the deacidification of books.

The already mentioned DE 39 04 111 Al indicates the use of microwaves for drying the books following treatment; a rapid treatment of the books that does not cause damage is thereby possible.

The potential for heating a material in a microwave field is essentially dependent on its dielectric value epsilonr and the dielectric loss factor tan delta, both of which are substance-specific properties: the higher these values, the better is the potential for heating the material in the microwave field.

The literature indicates that these values are comparatively low for siloxanes of the indicated type, with epsilonr=ca. 2–3 and tan delta=ca. 1–2×10–5.

Unexpectedly, it has been demonstrated that books which are saturated with siloxanes having a chain length of 2–4 silicon atoms can be heated to sufficient temperatures in a microwave field in a short time.

Thus, e.g., a straight chain siloxane sample with 4 silicon atoms (n=2) and a weight of 1 kg can be heated to 80° C. within a few minutes at a frequency of 2450 MHz with a microwave power capacity of 600 W.

The solvents according to the invention are thus just as suitable as the previous solvents for application in efficient processes of the indicated type using microwave drying. But applications in other types of conventional drying procedures which do not use microwaves are also possible.

It is precisely this relatively weak, high frequency energy coupling that permits the books to be dried in a particularly safe manner; in the event of very intense coupling and thereby very rapid warming of the solvent saturated books, there is a danger that the books may be damaged or even destroyed through spontaneous vapor formation in the bulk of the book.

A further advantage when using the indicated siloxane for the deacidification of books is due to the lower density of the siloxane, which, for example, is 0.761 g/cm3 (for n=0) or 0.818 g/cm3 (for n=1).

While the use of fluorohydrocarbons and chlorofluorohydrocarbons, causes books to float as a result of the high density of these solvents, this is avoided by using the solvents according to the invention, whereby the operational aspects become simplified. The siloxanes according to the invention are very compatible with the known neutralizing agent methylmagnesium carbonate. But they can also be used with other, possibly future organo-metallic compounds, which may prove themselves in one way or another as an efficacious agent of treatment for mass deacidification.

In one of the experiments, for example, methylmagnesium carbonate solution (magnesium content 3%, dissolved in alcohol and 87.5 g hexamethyldisiloxane) was used for deacidification instead of the usual CFHC solvents. Paper treated with this solution underwent an increase in pH value from 4.5 in untreated paper to 8.5; the free acids in the paper were neutralized, and simultaneously an alkali buffer reserve was incorporated in the paper. Damage to the paper or to the text was not observed.

We claim:

1. A material for mass deacidifying books and other paper products in an environmentally safe manner comprising:

an active agent for mass deacidifying said books and other paper products; and a solvent for said active agent, said solvent including methylsiloxane containing 2–4 silicon atoms, or a mixture of said methylsiloxanes.

2. The material according to claim 1, wherein the solvent is or includes hexamethyldisiloxane.

3. The material according to claim 1 wherein terminal silicon valences of all or several of the methylsiloxanes are occupied by methyl groups.

4. The material according to claim 2 wherein terminal silicon valences of all or several of the methylsiloxanes are occupied by methyl groups.

5. The material according to claim 1, wherein one or more silicon valences of all or several methylsiloxanes are occupied by H atoms.

6. The material according to claim 2, wherein one or more silicon valences of all or several methylsiloxanes are occupied by H atoms.

7. The material according to claim 1, wherein one or more silicon valences of all or several of the methylsiloxanes are occupied by functional groups which are able to react with cellulose in paper.

8. The material according to claim 2, wherein one or more silicon valences of all or several of the methylsiloxanes are occupied by functional groups which are able to react with cellulose in paper.

9. The material according to claim 1, wherein one or more silicon valences that are not occupied by methyl groups can be selectively occupied by H atoms and/or by functional groups which can react with cellulose in paper.

10. The material according to claim 2, wherein one or more silicon valences that are not occupied by methyl groups can be selectively occupied by H atoms and/or by functional groups which can react with cellulose in paper.

11. A method of mass deacidifying paper products in an environmentally safe manner comprising:

contacting said paper products with a composition for mass deacidifying said paper products;

said composition composed of an active agent for mass deacidifying said paper products and a solvent for said active agent, said solvent including methylsiloxane containing 2–4 silicon atoms, or a mixture of said methylsiloxanes.

12. The method of claim 11 wherein said paper products are books.

13. The method of claim 11 wherein said paper products contacted with said composition are heated in a microwave field to effect drying.

* * * * *